United States Patent [19]

Bergero et al.

[11] Patent Number: 4,922,215

[45] Date of Patent: May 1, 1990

[54] POWER DIVIDER IN WAVEGUIDE FORM

[75] Inventors: Jean-Pierre Bergero, Limeil Brevannes; Claude Couasnard, Meudon La Foret, both of France

[73] Assignee: Thomson-CSF, Paris, France

[21] Appl. No.: 312,604

[22] Filed: Feb. 21, 1989

[30] Foreign Application Priority Data

Feb. 23, 1988 [FR] France ..... 88 02127

[51] Int. Cl.[5] ..... H01P 5/12

[52] U.S. Cl. ..... 333/137; 333/21 A

[58] Field of Search ..... 333/125, 137, 21 A; 343/776

[56] References Cited

U.S. PATENT DOCUMENTS 2,455,158 11/1948 Bradley .
3,165,743 1/1965 Hatkin .
3,665,481 5/1972 Low et al. .
4,717,897 1/1988 Gehin et al. ..... 333/125
4,764,775 8/1988 Craven ..... 333/125 X

FOREIGN PATENT DOCUMENTS 1314408 12/1962 France .
2255716 7/1975 France .

OTHER PUBLICATIONS

International Journal of Electronics, vol. 57, no. 6, Dec., 1984, pp. 1219–1224; G. Janzen.

*Primary Examiner*—Paul Gensler
*Attorney, Agent, or Firm*—Oblon, Spivak, McClelland, Maier & Neustadt

[57] ABSTRACT

Disclosed is a power divider in waveguide form, for a microwave power transmission circuit, working at high power in the rectangular $TE_{10}$ mode. This power divider is formed by the juxtaposition of:

a rectangular, input waveguide working in its fundamental mode, receiving the power to be divided through one of its ends, and having another closed end;

a circular waveguide propagating the $TM_{01}$ mode connected to the rectangular, input waveguide by a lateral opening in such a way that the axes of the two guides are perpendicular;

a group of n output waveguides, placed at the output of the circular waveguide and distributed in a ring before its free end, working in the $TE_{10}$ mode, each transmitting a fraction of the power introduced into the input. The device can be applied to microwave power transmission circuits.

4 Claims, 3 Drawing Sheets

POWER DIVIDER IN WAVEGUIDE FORM

BACKGROUND OF THE INVENTION

1. Field of the Invention

The present invention concerns a power divider in waveguide form, for microwave power transmission circuits working at high power.

2. Description of the Prior Art

The techniques associated with high power millimetric and centrimetric waves are currently undergoing development because of generators and amplifiers such as gyrotrons.

There already are existing waveguide power dividers. Two types have been developed extensively: Y type and T type dividers. These dividers are formed by an input waveguide which gradually changes shape so as to obtain two output waveguides. The unit has a T shape or a Y shape.

These power dividers enable the power introduced into the input guide to be divided into two equal or unequal parts. This depends on the dimensions of the section of the waveguide forming the three arms of the T or Y. When all three arms have the same section, the power transmitted in the two output waveguides will be half the power injected at input. These power dividers are also called 3 dB couplers.

If it is desired to divide the power introduced at input into more than two equal parts, several T or Y dividers should be series mounted. However, this type of assembly cannot be used to achieve division by an odd number or by an even number which is not a power of two. Moreover, power dividers of this type are generally quite bulky, especially if several of them have to be series mounted to obtain a division by a value which is a power of two.

An object of the present invention is to overcome these drawbacks by presenting a power divider, in waveguide form, which is compact and makes it possible to obtain, in each of the n output waveguides, a fraction of the power injected into the input waveguide, where n may be a whole number greater than or equal to 2. This number n is, however, restricted to the quantity of output waveguides that can be juxtaposed mechanically.

The power divider permits the transmission of high power. It is made by the juxtaposing of several waveguide sections (hereinafter called "pieces"). It has a particularly compact shape, even if the number n of output waveguides is quite large. It works in the rectangular $TE_{10}$ mode, which is the fundamental mode of rectangular section waveguides. This mode is frequently used in microwave power transmission circuits.

SUMMARY OF THE INVENTION

The present invention proposes:

a power divider in waveguide form for microwave power transmission circuits, working at high power in the rectangular $TE_{10}$ mode, said power divider comprising:

a rectangular, input waveguide working in its fundamental mode, receiving the power to be divided through one of its ends, and having another closed end;

a circular waveguide propagating the $TM_{01}$ mode, having a first input connected to the rectangular, input waveguide by a lateral opening, placed on the large side of the rectangular waveguide, near its closed end, in such a way that the axes of the two guides are perpendicular;

said divider further comprising a group of n output waveguides, working in the rectangular $TE_{10}$ mode, distributed in a ring before a second end of the circular waveguide, so at least one of their large sides is cut in a substantially perpendicular direction by a radius of the cross-section of the circular guide, and so that they each transmit, in the $TE_{10}$ mode, a fraction of the power introduced into the rectangular, input waveguide.

BRIEF DESCRIPTION OF THE DRAWINGS

Other features and advantages of the invention will appear from the following description, illustrated by the appended figures, of which.

In the figure, the same references are repeated for the same elements.

DESCRIPTION OF PREFERRED EMBODIMENTS

Figure 1:
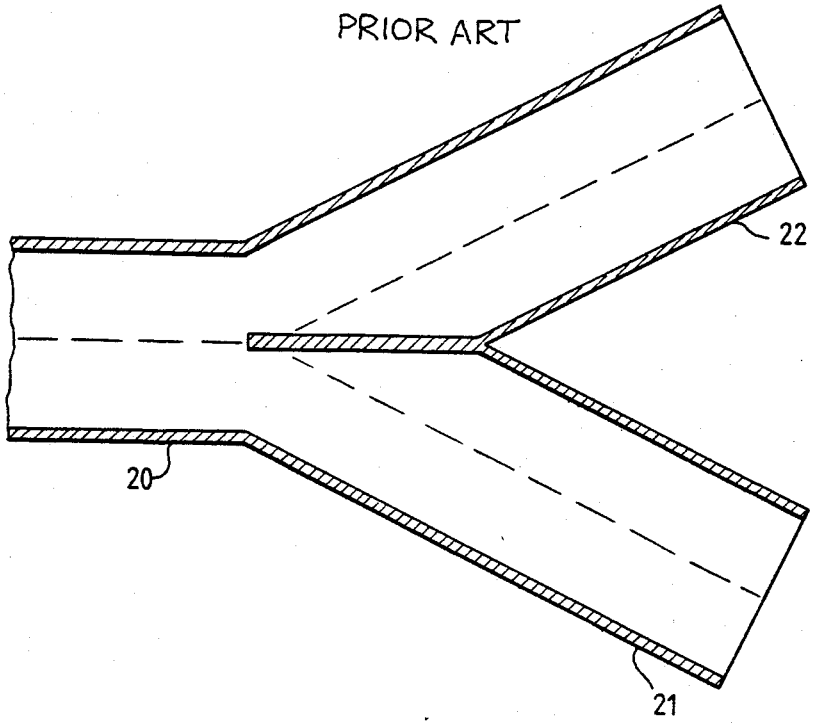
FIG. 1 PRIOR ART
FIG. 1 shows a longitudinal section of a art Y type power divider.

The waveguide power divider shown in FIG. 1 is of the Y type.

The input waveguide 20 is, for example, a rectangular waveguide. It propagates an electromagnetic wave in the rectangular $TE_{10}$ mode.

This waveguide 20 is gradually made to change its shape in order to obtain two output waveguides 21, 22.

In our example, the two output waveguides 21, 22, have the same section. They also have the same section as the input waveguide 20. The power transmitted in each of the output waveguides 21, 22, will be half the power introduced into the input waveguide 20. This assembly is a power divider by two. In adding, to the output of each of the two waveguides 21, 22, a Y type power divider, as described above, a power divider by four would be obtained. With this type of assembly, the power is always divided by a value which is a power of two.

Figure 2:
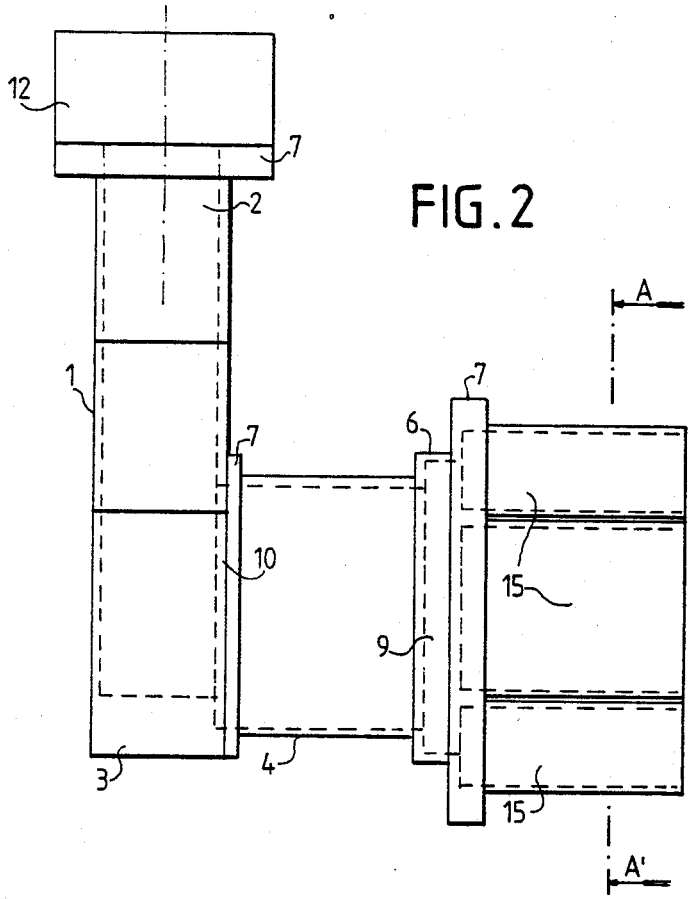
FIG. 2 shows a longitudinal section of a power divider according to the invention.

FIG. 2 shows a longitudinal section of a power divider according to the invention. This power divider is formed by the juxtaposition of several waveguide pieces.

Then input is achieved by a waveguide 1 with a rectangular section, working in its fundamental mode. This rectangular, input waveguide 1 is excited by an electromagnetic wave source 12 placed at its upper end 2. Its lower end 3 is closed. A first end of a circular section waveguide 4 is connected to the rectangular, input waveguide 1 by a lateral opening 10, placed on the large side of the rectangular, input waveguide 1, close to its closed end 3.

The axes of the two waveguides are perpendicular.

The waveguide 4 propagates the $TM_{01}$ mode because the distribution of the magnetic field in the rectangular, input waveguide 1 at the level of the opening 10, corresponds to that of the $TM_{01}$ mode in the circular section waveguide 4. The opening 10 in the rectangular, input waveguide 1 is large-sized, thus permitting operation at high power.

This structure enables the rectangular $TE_{10}$ mode to be converted into the circular $TM_{01}$ mode.

The power injected into the rectangular, input waveguide 1 is transmitted to the circular waveguide 4.

A group of n output waveguides 15 is placed at the other end 9 of the circular waveguide 4. Their longitudinal axes are parallel to that of the circular guide 4, but are not the same as this axis.

These n output waveguides 15 are distributed in a ring at the periphery of the circular waveguide 4. Each of these n output waveguides 15 has a rectangular or similar shaped section: for example, trapezoidal, elliptical, with rounded corners, etc.

They are positioned in such a way that their big sides 13 are cut in a substantially perpendicular direction by a radius of the cross-section of the circular waveguide 14. They are chosen to be monomode waveguides an all have the same length. The four rectangular waveguides 15 are fed in phase.

There is any number n of output waveguides 15, but this number is greater than or equal to two.

In our example, we have shown four output waveguides 15 which have the same rectangular section.

As the power injected into the rectangular, input waveguide 1 is P, the power transmitted in each of the n output waveguides 15 will be $p=P/n$ if the output waveguides 15 have the same section.

In the example chosen, each output waveguide 15 will transmit a quarter of the power injected into the rectangular, input waveguide 1.

Figure 3:
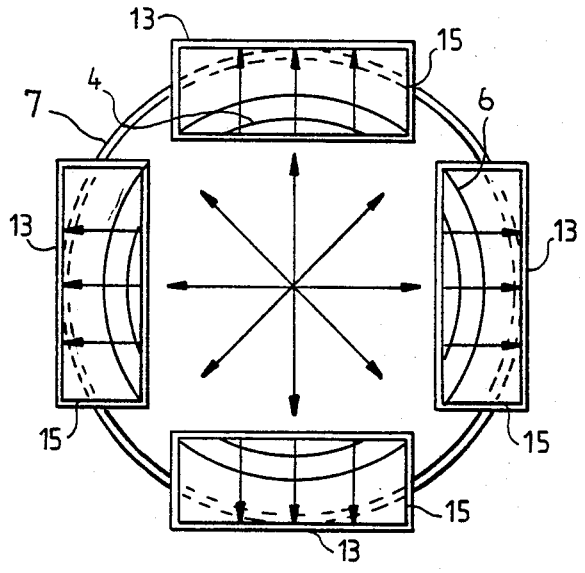
FIG. 3 shows a cross-section of the power divider along the axis AA' of FIG. 2.

FIG. 3 gives a sectional view, along the axis AA', of the four output waveguides 15. The distribution of the electrical field is indicated inside each of them.

The distribution of the electrical field in the circular waveguide 4 is also shown.

In each of the output waveguides 15, the rectangular $TE_{10}$ mode is propagated. For, the distribution of the electrical field in the circular waveguide 4, propagating the $TM_{01}$ mode, is along the radii of its cross-section. In the n output waveguides 15, this distribution corresponds to that of the rectangular $TE_{10}$ mode.

In order to obtain optimum functioning, a compromise may have to be made, between the dimensions of the n output waveguides 15 and those of the circular waveguide 4, on the one hand, and, between the distances of each of the axes of the n waveguides and the axis of the circular waveguide 14.

This is why the diameter of the circular waveguide 4, at the junction with the n output waveguides 15, may be different from the optimum diameter of the circular waveguide 4 used for the first transition, namely to convert the rectangular $TE_{10}$ mode into the circular $TM_{01}$ mode.

In this case, a diameter transition should be incorporated between the circular waveguide 4 and the n output waveguides 15. This transition may be achieved by a single jump, as shown in 6 at figure 2, by successive leaps or gradually. In the latter case, a gradual connection element will be introduced.

FIGS. 4*a* to 4*f* show various possible shapes of the cross-section of the n output waveguides 15.

Figure 4A:
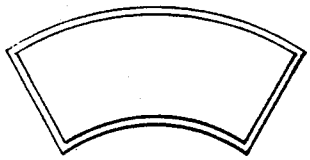
FIGS. 4*a* to 4*f* show various possible sections for the n output waveguides.
Figure 4B:
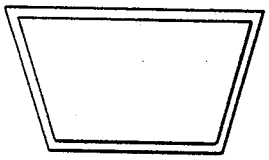
Figure 4C:
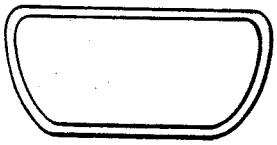
Figure 4D:
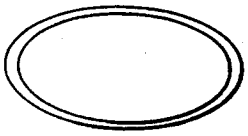
Figure 4E:
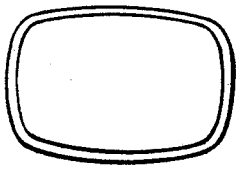
Figure 4F:
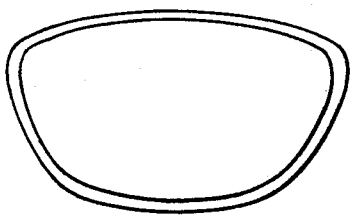

These sections may be shaped like a ring sector (FIG. 4*a*), or they may be trapezoidal (FIG. 4*b*), trapezoidal with rounded corners (FIG. 4*c*), elliptical (FIG. 4*d*), rectangular with four convex sides (figure 4*e*), trapezoidal with four convex sides (FIG. 4*f*). Other forms may also be used.

The sections shown in FIGS. 4*a* to 4*c* and 4*f* enable a maximum number of output waveguides 15 at the periphery of the circular waveguide 4 because they are slightly trapezoidal.

This makes it possible to obtain a division of power by a fairly large number.

The sections shown in FIG. 4*d* to 4*f* permit the transmission of greater power because of their convex sides.

The elements referenced 7 in FIG. 2 are clamps used to connect one waveguide to another.

What is claimed is:

1. A power divider in waveguide form for microwave power transmission circuits, working at high power in the rectangular $TE_{10}$ mode, said power divider comprising:

a rectangular, input waveguide working in its fundamental mode, receiving the power to be divided through one of its ends, and having another closed end;

a circular waveguide propagating the $TM_{01}$ mode, having a first input connected to the rectangular, input waveguide by a lateral opening, placed on the large side of the rectangular waveguide, near its closed end, in such a way that the axes of the two guides are perpendicular; said divider further comprising a group of n output waveguides, working in the rectangular $TE_{10}$ mode, distributed in a ring before a second end of the circular waveguide, so at least one of their large sides is cut in a substantially perpendicular direction by a radius of the cross-section of the circular guide, and so that they each transmit, in the $TE_{10}$ mode, a fraction of the power introduced into the rectangular, input waveguide.

2. A power divider in waveguide form for microwave power transmission circuit according to claim 1, wherein the cross-section of the n output waveguides is substantially rectangular.

3. A power divider in waveguide form for microwave power transmission circuit according to claim 1 or 2, wherein the n output waveguides are identical.

4. A power divider in waveguide form for microwave power transmission circuit according to claim 3, wherein the n output waveguides each transmits one $n^{th}$ of the power introduced into the rectangular, input waveguide.

* * * * *